US006334536B1

(12) United States Patent
Kanning

(10) Patent No.: US 6,334,536 B1
(45) **Date of Patent: *Jan. 1, 2002**

(54) HANGING ORNAMENT STORAGE CONTAINER

(76) Inventor: Amy Kanning, 20470 N. Raum Rd., Lawson, MO (US) 64062

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,786

(22) Filed: Jul. 2, 1998

(51) Int. Cl.[7] ..... B65D 81/02

(52) U.S. Cl. ..... 206/521; 206/565; 206/6.1; 206/419

(58) Field of Search ..... 206/561, 565, 206/583, 6.1, 521, 776–778, 419, 420; 229/120.31, 120.34, 120.37, 120.38

(56) References Cited

U.S. PATENT DOCUMENTS 1,842,380 A * 1/1932 Andrews ..... 229/120.33
2,718,326 A * 9/1955 Le Blanc ..... 206/561
2,770,357 A * 11/1956 Sheard ..... 206/291
2,950,003 A * 8/1960 Simmons et al. ..... 206/565
3,009,625 A * 11/1961 Ackley et al. ..... 229/120.33
3,139,978 A * 7/1964 Moglia ..... 206/291
3,242,960 A * 3/1966 Schwarzman ..... 229/120.02
3,880,343 A * 4/1975 Rockefeller ..... 229/120.02
3,949,930 A * 4/1976 Giordano ..... 206/562
3,963,168 A * 6/1976 Frum ..... 229/28 R
4,030,603 A * 6/1977 Angell ..... 206/583
4,376,507 A * 3/1983 Nauheimer ..... 229/15
4,440,297 A * 4/1984 Wohlfahrt ..... 206/583
4,729,474 A * 3/1988 Lanius et al. ..... 206/315.11
4,951,867 A * 8/1990 McManus ..... 229/120.33
5,117,971 A * 6/1992 Fisher ..... 206/6.1
5,190,212 A * 3/1993 Morris ..... 229/120.38
5,261,529 A * 11/1993 Holland ..... 206/6.1
5,725,119 A * 3/1998 Bradford et al. ..... 206/583
5,871,101 A * 2/1999 Alden ..... 206/583
5,950,915 A * 9/1999 Moen ..... 229/120.38

* cited by examiner

*Primary Examiner*—Paul T. Sewell
*Assistant Examiner*—Jila M. Mohandesi
(74) *Attorney, Agent, or Firm*—Shook, Hardy & Bacon LLP

(57) ABSTRACT

A storage container for storing ornaments in a hanging orientation is provided. The container is comprised of a box and a plurality of ornament supportable cross-members which extend across the opening defined by the box. In use, a person hangs ornaments from the cross-members by placing a portion of the ornament's hook in a hole formed within the cross-members.

7 Claims, 3 Drawing Sheets

HANGING ORNAMENT STORAGE CONTAINER

FIELD OF THE INVENTION

The present invention relates to a storage container for storing ornaments in a hanging orientation. More particularly, this invention relates to a storage container having a number of parallel cross-members reaching from one side to another which can be used for storing ornaments in a hanging orientation from the cross-members.

BACKGROUND OF THE INVENTION

It is a common occurrence for people to collect and accumulate several different types of decorative items of a seasonal nature these days. These items are placed out around the house during their particular season and then stored until used again the following year. Many of these items can be quite valuable because of monetary (such as a collectors item) or sentimental (such as a family heirloom) reasons and are almost always fragile. The fragile nature of these valuable items makes the method used to store them important.

One such seasonal item that can be valuable and require careful storage is a Christmas tree ornament. Christmas tree ornaments are most often made of a thin walled glass ball which has an opening in the top where an ornament hanger or hook can be attached. The ornaments are then hung on the branches of a Christmas tree during the Christmas season.

After Christmas, most people store their ornaments by laying them as gently as possible in the bottom of a box, one on top of the other until the box is filled. This method has several drawbacks. The most important drawback is that regardless of how carefully the ornaments are put in the box and the box is handled, inevitably, some of the ornaments get broken or smashed from the weight of other ornaments resting on them.

Another drawback to this method of storage is that the ornament hooks always get tangled together making tree decorating the following season difficult and time consuming. Therefore, there is a need for a storage container which can quickly, easily and effectively store ornaments in a safe and organized manner. The present invention overcomes the drawbacks of the prior art and fills these and other needs.

SUMMARY OF THE INVENTION

It is a general object of the present invention to quickly and efficiently store ornaments in a safe and organized hanging arrangement.

It is an object of the present invention to provide an ornament storage container that is simple and easy to use.

Another object of the present invention is to store ornaments in a way that greatly reduces the possibility of breakage or smashing.

A further object of the present invention is to provide an ornament storage container that is inexpensive and easy to manufacture.

In order to overcome the above stated problems and limitations and to achieve the noted objects, there is provided an ornament storage container which can be used to store hanging ornaments in successive rows in a hanging orientation.

In general, the ornament storage container comprises a box with successive parallel cross-members running from one side of the box to an opposite side, that have been adapted to securely receive an ornament hook of a hanging ornament, and a lid to cover the box and thereby keep dust or pests out during storage.

One embodiment is preferably made entirely out of corrugated cardboard and in such a manner that the box may be folded up for ease in packaging for initial sale, ease in storing the container when not in use, ease in manufacturing and to provide an inexpensive product.

Another embodiment is preferably made entirely out of plastic. This arrangement can provide a lid for the container that can be secured in an air-tight fashion in order to prevent pests, such as mice, moths or bugs, or water from being able to enter the container and damage any ornaments that are susceptible to such damage, namely cloth or fabric type ornaments.

A third embodiment is preferably a combination of cardboard and plastic components. This combination is preferably a cardboard support structure made to fit inside already available standard plastic storage containers. This cardboard insert would allow consumers to retrofit their existing storage containers and thereby convert them into hanging ornament storage containers of the present invention.

Further objects, features, and advantages of the present invention over the prior art will become apparent from the detailed description of the drawings which follows, when considered with the attached figures.

DESCRIPTION OF THE DRAWINGS

The objects and features of the invention noted above are explained in more detail with reference to the drawings, in which like reference numerals denote like elements, and in which.

DETAILED DESCRIPTION OF THE PREFERRED EMBODIMENTS

Figure 1:
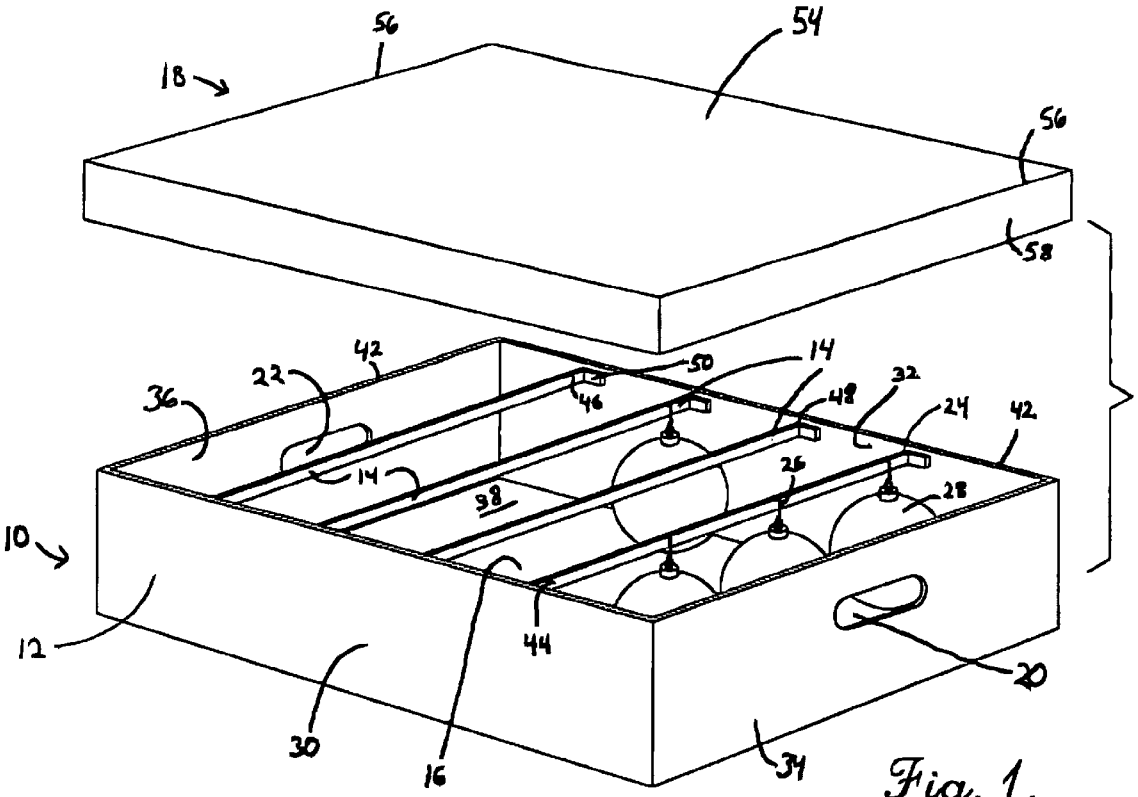
FIG. 1 is a perspective view of a first embodiment of the hanging ornament storage container of the present invention in use.

Referring now to the drawings in detail and initially to FIG. 1, numeral 10 generally designates a hanging ornament storage container constructed in accordance with the present invention. The container 10 is primarily comprised of a box 12 and a plurality of ornament supportable cross-members 14 which are supported by the box 12 over a bottom portion 16 thereof The container 10 preferably also includes a lid 18, a pair of handles 20,22, and holes or apertures 24 in the cross-members 14 to receive a hook 26 of a Christmas ornament 28.

Figure 2:
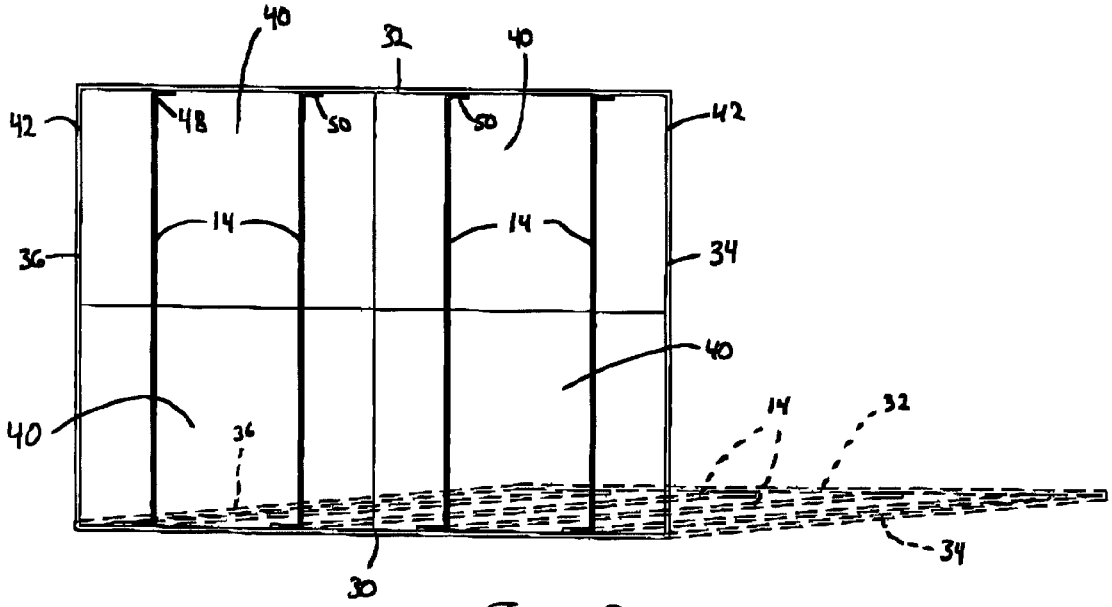
FIG. 2 is a plan view of the first embodiment of the container of the present invention with the broken lines showing the container in a collapsed position.

The preferred first enbodiment of the box 12, as pictured in FIG. 1, is preferably made of corrugated cardboard and has a front wall 30, a rear wall 32, two side walls 34,36, and the bottom 16. An open volume or expanse 38 is formed inside of the walls 30,32,34,36 and above the bottom 16 of the box 12. The bottom 16 of the box 12, as best illustrated in FIG. 2, is comprised of several flaps 40 which can be interlocked or folded together when the box 12 is in use. The solid line depiction in FIG. 2 shows the container 10 in a first, rectangular, open, use position. The dashed line depiction of the drawing shows the container 10 in a collapsed, storage or sale position. The flaps 40 allow the box 12 to be folded down and collapsed to a flat condition when not in use. This smaller shape lets the container 10 take up less space when not in use and less space on a shelf in a store for initial sale. This box 12 is of a type generally known in the art.

Figure 6:
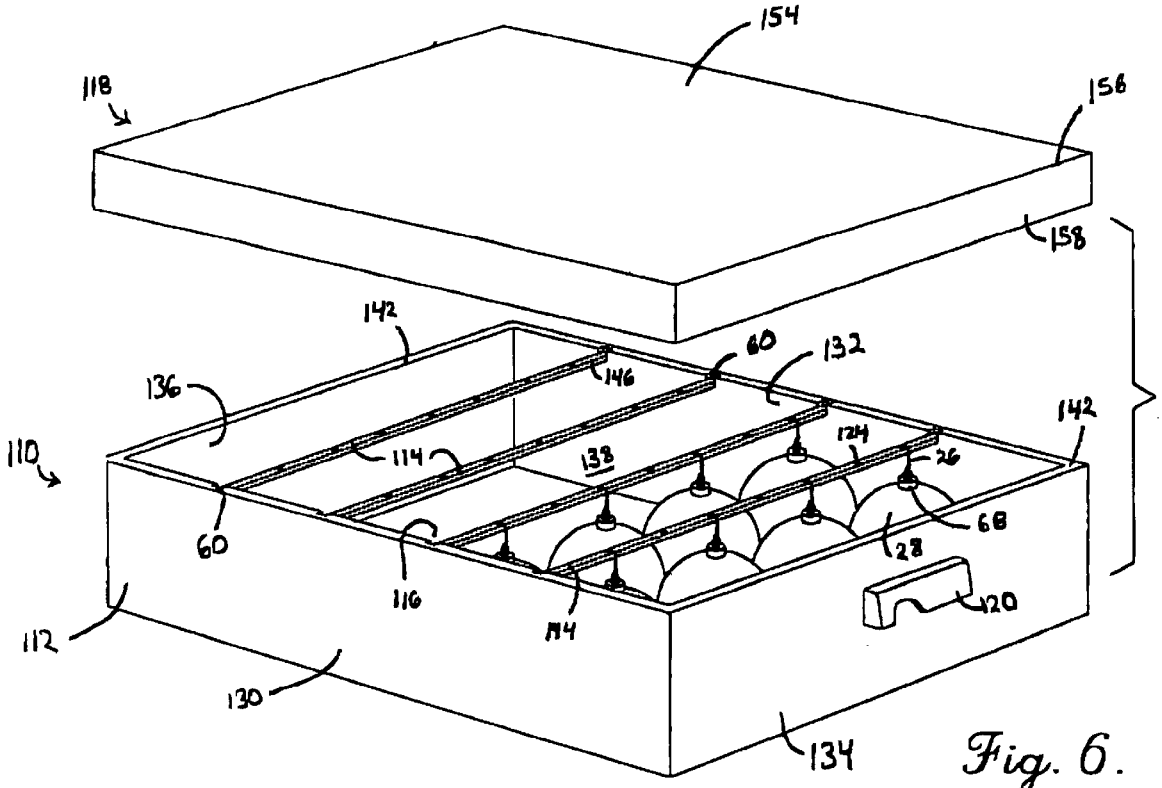
FIG. 6 is a fragmentary plan view of a container constructed in accordance with the second embodiment of the present invention.

The box 12 preferably also includes the two handles 20,22 for carrying the container 10. Both handles 20,22 are preferably located on their respective side wall 34,36 equidistant from the front wall 30 and the rear wall 32, and closer to an upper periphery 42 of the box 12 than to the bottom 16. FIG. 1 illustrates the handles 20,22 as holes in the side walls 34,36. FIG. 6, on the other hand, illustrates a handle 120 that enables one to make an air-tight container 1 0. Both of these types of handles 20,22 and 120 are within the scope of the present invention, as are other handles which are known by one of ordinary skill in the art to be equivalent.

The ornament supportable cross-members 14 are each preferably an elongate piece having a front end 44 and an opposing rear end 46. The cross-members 14 also preferably have an upper surface 45 and a lower surface 47. Each cross-member 14 is positioned in the box 12 such that the front end 44 of the cross-member 14 is supported by the front wall 30 and the rear end 46 of the cross-member 14 is supported by rear wall 32. The plurality of cross-members 14 are preferably arranged in a substantially parallel orientation to each other and are preferably also substantially parallel to the sides 34,36. The cross-members 14 could, of course, be of different shapes or in a different orientation within the box provided they are able to perform the function of supporting ornaments 28 in a hanging orientation. Additionally, the cross-members 14 could span over only a portion of the bottom 16 and could be supported in other manners than attachment to the sides 34,36.

In the preferred first embodiment, each cross-member 14 includes a plurality of holes or apertures 24 therein for receiving the hook 26 of a Christmas ornament 28. While the cross-members 14 have been found to work fine without holes 24, the holes 24 are beneficial because they allow a user to hang an ornament 28 on the cross-member 14 in a desired location. If the hook 26 of the ornament 28 is merely placed over the cross-member 14, the ornament 28 may slide along the cross-member 14 during movement of the container 10 which may result in some ornaments 28 hitting each other and becoming damaged. The cross-members 14 could have annular grooves (not pictured) placed therein to prevent hooks 26 from sliding along the cross-members 14, however, the holes 24 have been found to be satisfactory in most applications.

In the preferred first embodiment of the present invention, the cross-members 14 are made of corrugated cardboard. In this embodiment, the cross-members 14 are supported by the front and rear walls 30,32 at their ends 44,46 preferably by gluing a portion of the ends 44,46 to the walls 30,32 near the upper periphery 42 thereof. The ends 44,46 of the cross-members 14 each preferably have a bend 48. The bends 48 in the ends 44,46 of the cross-members 14 are in opposite directions of each other. This allows the cross-members 14 to remain attached to the box 12 when the box 12 is folded down and collapsed to a flat condition when not in use (dashed line depiction in FIG. 2). Also, bending the ends 44,46 of the cross-members 14 in this manner allows the box 12 to collapse more easily than if the ends 44,46 were bent in the same direction.

The bend 48 also forms a tab 50 at the ends 44,46 of the cross-members for attaching the cross-members 14 to the walls 30,32 of the box 12 (best viewed in FIG. 2). The tabs 50 are perpendicular to the cross-members 14 when the box 12 is in use. The tabs 50 also provide relatively large surface areas for gluing to the box 12, thus providing a strong attachment of the cross-members 14 that is able to stand up to repeated folding and unfolding of the box 12. Alternatively, or additionally, the tabs 50 may be attached to the walls 30,32,34,36 by staples 52 (FIG. 3).

Figure 3:
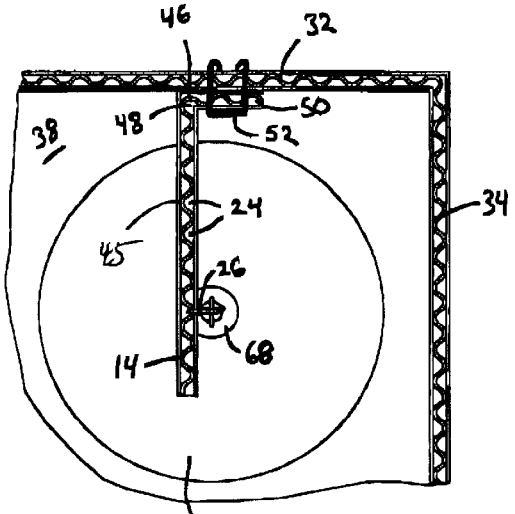
FIG. 3 is a fragmentary plan view of a corner portion of the container shown in FIGS. 1 and 2.
Figure 4:
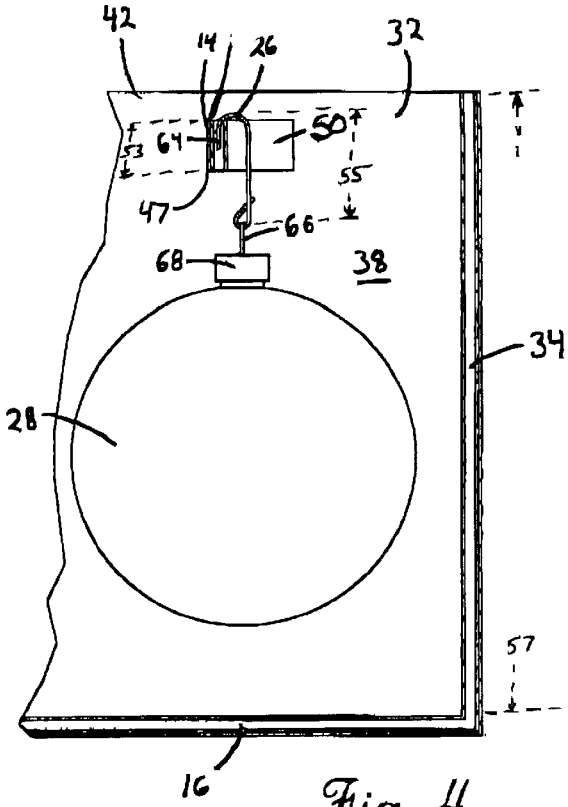
FIG. 4 is a fragmentary sectional view taken on a vertical plane through the container shown in FIGS. 1

As best illustrated in FIGS. 1, 3 and 4, corrugated cardboard, when used to make the cross-members 14, should be positioned such that the tunnels naturally provided by the corrugations are m a vertical orientation. This arrangement has several benefits.

One benefit provided by this arrangement is greater rigidity in the cross-members 14 than if the tunnels were in a horizontal orientation Even greater rigidity can be achieved by doubling up the cross-members 14 or by using thicker cardboard than what is illustrated. Another benefit is that the vertical tunnels naturally provide the plurality of desired holes 24 on the upper surface of the cross-members 14 capable of receiving the ornament hooks 26. Other benefits include ease of manufacturing, low material costs, light weight yet sturdy components, and its ready availability in the container industry.

In all of the embodiments described herein, an important feature of the invention is that the lower surface 47 of the cross-menbers 14 spaced apart from and above the bottom 16 of the container 10. By spacing the lower surfaces 47 of the cross-menbers 14 away from the bottom 16, a portion of the ornaments 28 being stored can be positioned between the lower surface 47 of the cross-members 14 and the bottom 16, as clearly illustrated in FIGS. 4 and 7. This arrangement permits the ornaments to depend freely downwardly from the cross-members 14. If the lower surfaces of the cross-members 14 abutted the bottom 16 of the container 10, such that the cross-members 14 were simply walls or dividers, the ornaments being stored would not be able to depend freely downwardly, but instead would be forced to rest up against a side of tee divider. Such an arrangement would not be beneficial because as the container is moved from place to place, the ornaments would bang up against the side of the divider and perhaps break. In the present invention, as the container is moved from place to place, the freely depending ornaments can swing to and fro without contacting the container or cross-members Accordingly, the cross-members 14 of the present invention are preferably supported on their ends 44, 46 by the walls of the container as opposed being supported on their lower surfaces 47 by the bottom 16 of the container 10 like a divider.

In addition to it being important that there be some distance between the lower surfaces 47 of the cross-members 14 and the bottom 16 of the container and that that distance be greater than a height of the ornaments 28 being stored (see FIGS. 4 and 7), the distance between the lower surface 47 and the upper surface 45 of a cross-member is important. The distance between the lower surface 47 and the upper surface 45 of a cross-member, which can also be called a cross-member height dimension 53, is important for the same reason it is important to have the lower surface 47 of the cross-member 14 spaced apart from the bottom, i.e. so an ornament 28 hanging from the cross-member 14 can depend freely and does not have to rest against the side of the cross-member 14.

Figure 7:
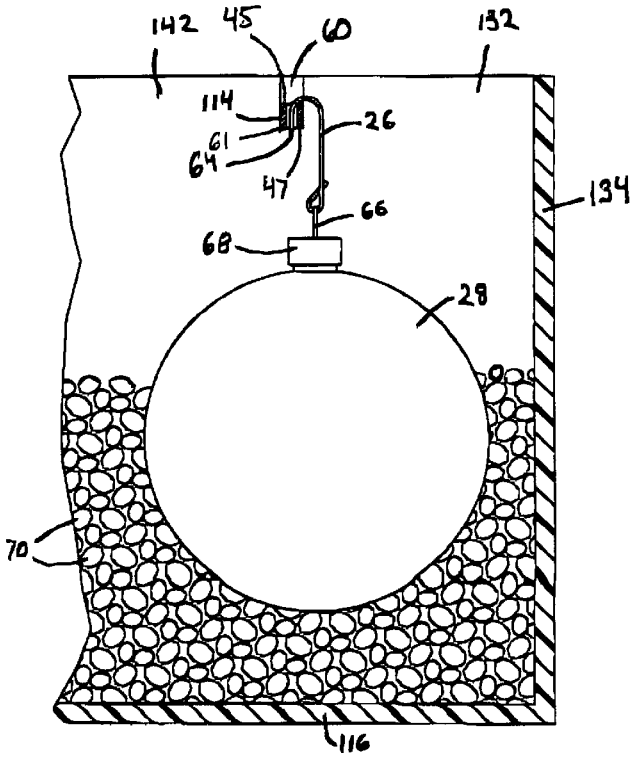
FIG. 7 is a fragmentary sectional view taken on a vertical plane through a container constructed in accordance with the second embodiment of the present invention in use.

As illustrated in FIGS. 4 and 7, the hook 26 has a hook height dimension 55. When the ornament 28 is hung from the cross-member 14, a portion of the hook 26 is received in one of the holes 24 in the upper surface 45 of the cross-member 14. Accordingly, if the cross-member height dimension 53 is very much larger than the hook height dimension 55, the book 28 is not long enough to position the ornament 28 in the space between the lower surface 47 of the cross-member and the bottom 16 of the container 10 and the ornament 28 must Test up against a side of the cross-member 14. As discussed above, such an arrangement has drawbacks the present invention overcomes.

In order to determine the proper cross-member height dimension 53 and the proper distance between the lower surface 47 of a cross-member 14 and the bottom of the container, it has been found beneficial to discuss the cross-nember height dimension 53 in terms of its relationship to a height dimension 57 of one of the walls 30, 32, 34, 36 of the container 10. As illustrated in FIGS. 4 and 7, the height dimension of the cross-menbers 14, 114 is less than half the height dimension of the right side walls 34, 134. More preferably, and as illustrated, the height dimension of the cross-members 14, 114 are less than one-third of the height dimension of the right side walls 34, 134.

The lid 18 is also of a type generally known in the art. The lid 18 preferably includes a flat cover portion 54 having an outer periphery 56. Depending downwardly from the outer periphery 56 of the cover portion 54 is a flange or an overlapping portion 58 which is designed to fit closely around and overlap the upper periphery 42 of the box 12 when the lid 18 engages the box 12. In addition to performing the function of closing the box 12 up, the cover portion 54 of the lid 18 also acts to prevent the hooks 26 from coming out of the holes 24 during movement of the container 10.

Figure 5:
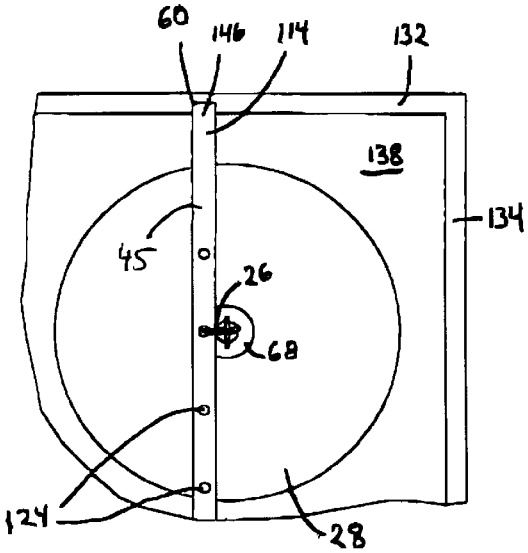
FIG. 5 is a fragmentary plan view of a corner portion of a container constructed in accordance with a second embodiment of the present invention.

A second embodiment of the present invention is illustrated in FIGS. 5, 6 and 7. In these figures, parts that are similar to or correspond to parts that are depicted in FIGS. 14 are identified by similar reference numbers in the 100s. In the second embodiment, all of the parts of the container 110 are made of plastic. The cross-member 114 is a plastic rod having a square or rectangular cross-section. Preferably, the cross-members 114 also have a plurality of evenly spaced holes 124 therethrough in a vertical orientation.

In this embodiment, each cross-member 114 is supported by the front and rear walls 130,132 at its ends 144, 146. Preferably, a plurality of notches 60 are formed in walls 30 and 32 adjacent to the upper periphery 142, and the ends 144 and 146 fit closely yet removably in the notches 60 to hold the cross-members 114 in place. This arrangement allows for the quick removal of all or some of the cross-members 114 such that the container 110 may be customized depending on its particular use and contents.

The notches 60 have a lower surface or ledge 61. When the ends 144, 146 of cross-members 114 are received in the notches 60, the lower surface 147 of the cross-members 114 abut tie ledge 61 and the cross-members are supported over the expanse 38 by the notches 60 in the walls 130, 132. Because the lower surface 147 of the cross-members 114 is spaced apart from the bottom 116 and because the lower surface 147 of the cross-members 114 abut the lower surface 61 of the notches 60, the lower surface 61 of the notches 60 and the notches 60 themselves must be spaced apart from the bottom I 16. The distance the lower surface 61 of the notches 60 is spaced apart from the bottom 116 of the container is related to the relationship between the cross-member height dimension and the wall height dimension. As illustrated in FIGS. 6 and 7, the lower surface 61 of the notch is in an upper half of the rear wall 132 and, more particularly, is in an upper third of the wall 132. The notches, including the lower surface or ledge 61, are preferably adjacent the upper periphery 142 of the container 110.

Other benefits of the second embodiment include the ability to have the lid 118 be air tight, to prevent water damage or to prevent damage from pests, and to provide a more durable container.

Figure 8:
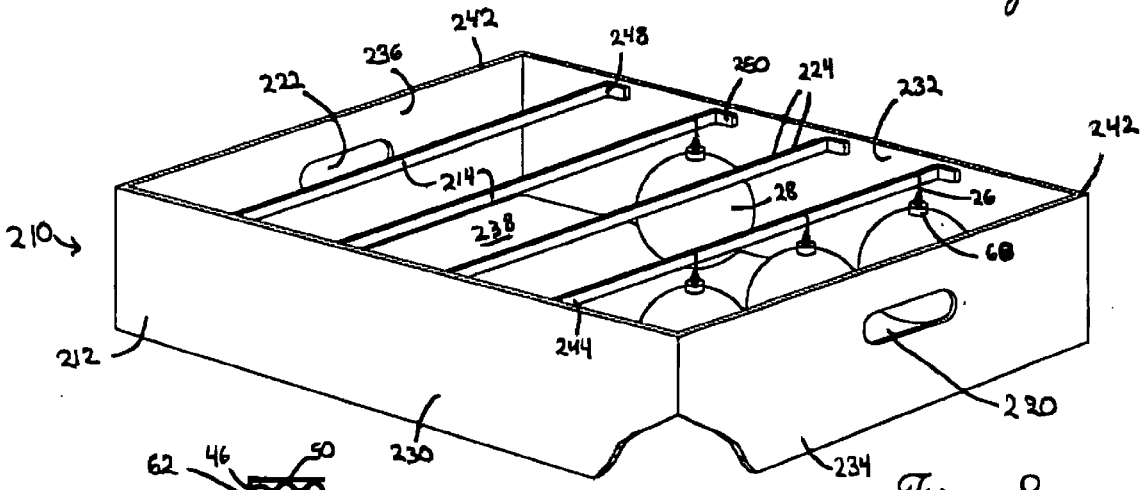
FIG. 8 is a perspective view of a hanging ornament support structure insert constructed in accordance a third embodiment of the present invention.

A third embodiment of the present invention is illustrated in FIG. 8. The third embodiment is a hanging ornament support structure insert 210. The insert 210 could be either of the embodiments previously described and illustrated but for the removal of the bottom 16 or 116. The insert 210 is constructed with walls 230,232,234,236 and cross-members 214 extending between opposing walls 230,232. Preferably the insert 210 is made to fit into previously existing and readily available plastic storage containers such as the type sold under the Rubbermaid® mark.

A benefit of this third embodiment is the ability of a consumer, who already owns a plastic storage container, to purchase the cardboard or plastic insert 210 and retrofit or convert their existing storage container into a hanging ornament storage container. Another benefit of this embodiment is the ability to stack several cardboard or plastic inserts 210 on top of each other and thereby provide individually removable layers of ornament hanging cross-members 214.

Figure 9:
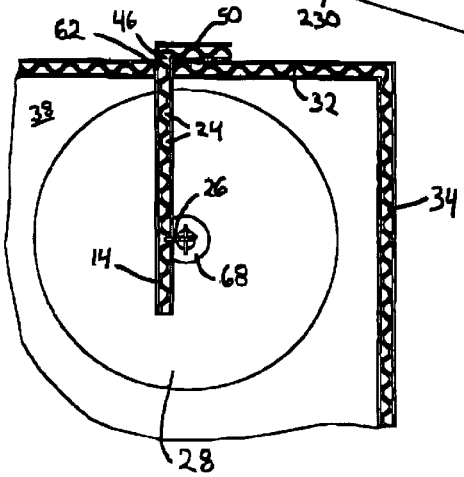
FIG. 9 a fragmentary plan view of a corner portion of a container constructed in accordance with a forth embodiment of the present invention.

FIG. 9 illustrates a fourth embodiment which is a variation to the first embodiment. In this embodiment, the cross-members 14 extend through slots 62 in the walls 30 and 32 such that the walls 30 and 32 support the cross-members 14 directly instead of indirectly via the tabs 50. In this arrangement, the tabs 50 are attached to the walls 30,32 on the outside of the container 10, as opposed to the inside of the container 10. While the primary function of the tabs 50 in the first embodiment is to provide support for the cross-members 14, the primary function of the tabs 50 in this embodiment is to secure the cross-members in place.

The slots 62 provide greater support than the first embodiment by allowing the cross- members 14 to rest directly on a portion of the walls 30,32. This allows the weight of the ornaments 28 to be passed directly from the cross-members 14 to the walls 30,32 without having to go through the tabs 50. While this embodiment sacrifices some of the collapsibility of the first embodiment, it provides sturdier cross-members 14.

In use, the user hangs an ornament 28 on a cross-member 14,114,214 by placing a free end 64 of the ornament hook 26 into one of the holes 24,124,224 in the cross-member 14,114,214. An end of the hook 26 opposite the free end 64 is attached to an anchor 66, a portion of which is located inside the ornament 28 and a portion of which is surrounded by a ring or cap 68. If extra protection is desired, the user may fill the container 10,110,210 with packing peanuts 79 (FIG. 7) after all of the desired ornaments 28 are hung inside. The holes 24,124,224 are selected so[]that adjacent ornaments 28 do not bang into each other. Similarly, the cross-members 14,114,214 are spaced apart far enough to avoid contact between ornaments 28 hanging on adjacent cross-members 14,114,214.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

I claim:

1. A storage container for storing Christmas ornaments having hooks in a hanging orientation, said container comprising:

a box having a plurality of walls and a bottom, said walls having an upper periphery and a plurality of notches located on the upper periphery thereof, said notches having a lower surface spaced apart from the bottom of the box, and said box being collapsible to a generally flat condition when not in use;

a plurality of generally rigid cross-members having opposing ends and upper and lower surfaces, said cross-members having a plurality of generally vertical apertures in the upper surfaces thereof for receiving the hooks of the ornaments, wherein said lower surface of said cross-members are spaced apart from said bottom, whereby portions of the ornaments being stored are positioned between the lower surface and the bottom when their hooks are received in the apertures in the upper surfaces, and wherein a distance between the lower surface of said cross-members and said bottom is greater than a distance between the lower surface of said cross-members and the upper surface of said cross-members; and means for attaching said opposing ends of said cross-members to opposing walls of said box adjacent said upper periphery of said walls, wherein said cross-members are supported by said walls;

wherein each of said notches are adapted to receive one of said opposing ends of said cross-members, wherein said means for attaching said cross-members to said wall includes positioning ends of said cross-members in mating notches and wherein the lower surface of the cross-members adjacent the ends of the cross-members abuts and is supported on the lower surface of the notches.

2. The container of claim 1, wherein the lower surface of the notches is in an upper one-third of the walls and is adjacent the upper periphery.

3. A storage container for storing ornaments in a hanging orientation, said container comprising:

a box having a peripheral wall and a bottom, said box defining an open expanse, and wherein said peripheral wall includes a plurality of pairs of opposed notches located in opposing sides of said peripheral wall adjacent an upper periphery thereof, wherein said notches include a ledge, and wherein said ledge is spaced apart from said bottom; and a plurality of cross-members extending across at least a portion of said open expanse of said box, said cross-members having opposed ends, said opposed ends being removably received in one of said pair of opposed notches in said peripheral wall, and upper and lower surfaces, said lower surface being spaced apart from said bottom to permit the stored ornaments to be positioned there between, wherein said lower surface of said cross-members adjacent said ends abuts and is supported on said ledge of said notches, and wherein each said cross-member has a plurality of ornament hanging locations provided therein, said ornament hanging locations and said cross-member being fabricated from a single piece.

4. The container of claim 3, wherein said ornament hanging locations are vertical apertures in said cross-member that are adapted to receive a hook of said ornament.

5. The container of claim 3, wherein said ornament hanging locations are grooves in said cross-member that are adapted to receive a hook of said ornament.

6. The container of claim 5, wherein said cross-member has a longitudinal axis and wherein said grooves in said cross-member are perpendicular to said longitudinal axis of said cross-member.

7. The container of claim 6, wherein said grooves circumscribe said cross-member.

* * * * *